United States Patent [19]

Riche

[11] Patent Number: 4,793,149

[45] Date of Patent: Dec. 27, 1988

[54] COOLING AND INSULATING DEVICE FOR CONTAINERS SUCH AS BEVERAGE CANS AND THE LIKE

[76] Inventor: Martin K. Riche, 1604 26th St., Ogden, Utah 84401

[21] Appl. No.: 78,585

[22] Filed: Jul. 27, 1987

[51] Int. Cl.[4] ..... F25D 3/08

[52] U.S. Cl. ..... 62/293; 62/372; 62/530; 165/46

[58] Field of Search ..... 62/293, 372, 530, 371; 126/263; 165/46

[56] References Cited

U.S. PATENT DOCUMENTS

| | | | |
|---|---|---|---|
| 3,282,068 | 11/1966 | Cain | 62/457 |
| 3,553,976 | 1/1971 | Cumine et al. | 62/293 X |
| 3,998,072 | 12/1976 | Shaw | 62/372 X |
| 4,281,520 | 8/1981 | Norwood | 62/372 |
| 4,344,303 | 8/1972 | Kelly, Jr. | 62/371 X |

FOREIGN PATENT DOCUMENTS

| | | | |
|---|---|---|---|
| 1455019 | 4/1973 | United Kingdom | 62/293 |

OTHER PUBLICATIONS

Photographs of product Freeze Sleeve made by Freeze Sleeves of America Inc., Dallas, Texas and Southwest Foam Molding Inc., Keller, Texas.

*Primary Examiner*—William E. Tapolcai

*Attorney, Agent, or Firm*—Mallinckrodt & Mallinckrodt

[57] ABSTRACT

A cooling and insulating holder for a container such as a beverage can or the like has a plurality of hollow arcuate reservoir pieces which fit together to form a ring with a receiving opening therein to receive the container. A resilient sleeve surrounds the reservoir pieces and holds them in ring configuration. In this way, a container larger than the normal opening in the ring may be inserted into the opening and the reservoir pieces will separate against the force of the resilient sleeve. If the opening in the ring is equal to or slightly less in diameter than the smallest diameter container expected to be used with the device, the device will maintain that and larger containers snugly within the ring with good contact between the container and the inner reservoir walls. The reservoir pieces are each filled with a coolant material which, in use, is frozen prior to insertion of the container to be cooled. The coolant then absorbs heat from a container and its contents placed in the opening as the coolant melts and warms.

15 Claims, 1 Drawing Sheet

COOLING AND INSULATING DEVICE FOR CONTAINERS SUCH AS BEVERAGE CANS AND THE LIKE

BACKGROUND OF THE INVENTION

1. Field

The invention is in the field of cooling and insulating devices for containers such as beverage cans.

2. State of the Art

There are many devices available for use in keeping canned beverages cool. Most of these take the form of an insulated cover that fits about the outside of a cooled can of beverage to reduce the heat transfer from the air to the can and beverage therein, thereby reducing the warming of the beverage. The most common of these are substantially rigid foam or styrofoam plastic cup-like containers into which a cooled can of beverage is placed or a flexible foam rubber material in the form of a sleeve that is placed around the can to similarly reduce the heat transfer to the can. Neither of these devices offers any cooling for the can or beverage therein. They merely serve to insulate around the can to keep it cool longer than would be the case without the insulation.

There has also been available a styrofoam cup-like insulating holder having a double wall to create a reservoir therein about the inner circumference thereof and with a coolant material which freezes so that the holder may be placed in a freezer to freeze the coolant material in the reservoir. When frozen, a beverage can may be placed in the receiving cup-like holder so it is surrounded by the frozen material. This not only insulates the beverage can but also cools it. However, the holder is sized to fit a certain size can. Smaller cans do not fit tightly in the holder against the reservoir so cooling efficiency is reduced, and larger cans cannot be used with the reservoir because they do not fit into the receiving opening in the holder. With the present variety of sizes of beverage cans, this is a problem.

SUMMARY OF THE INVENTION

According to the invention, a cooling and insulating holder for a container such as a beverage can has a plurality of hollow arcuate reservoir pieces which fit together to form a ring within which a container to be cooled may be placed. The reservoir pieces are each filled with a coolant material which can be cooled or frozen in the reservoir. Resilient means hold the reservoir pieces together in ring configuration so that a container larger than the opening in the ring will slide into the opening in the ring causing the pieces to move outwardly against the resilient means to thereby accommodate and hold the container within the ring. In this way, the reservoir pieces are maintained substantially in contact against the container. This provides efficient heat transfer between the container and the reservoir pieces when they are in cooled or frozen condition to thereby cool the container and its contents, and provides more effective insulation around the container when the container and reservoir pieces are at the same temperature. The resilient means preferably takes the form of a resilient, insulating sleeve surrounding the reservoir pieces.

THE DRAWINGS

In the accompanying drawings, which illustrate the best mode presently contemplated for carrying out the invention:

FIG. 1 is a perspective view showing the cooling and insulating device with a beverage can in place in the device;

FIG. 2, an exploded view showing the parts of the device and how they fit together;

FIG. 3, a vertical section taken on the line 3—3 of FIG. 1; and

FIG. 4, a horizontal section taken on the line 4—4 of FIG. 1.

DETAILED DESCRIPTION OF THE ILLUSTRATED EMBODIMENTS

Figure 1:
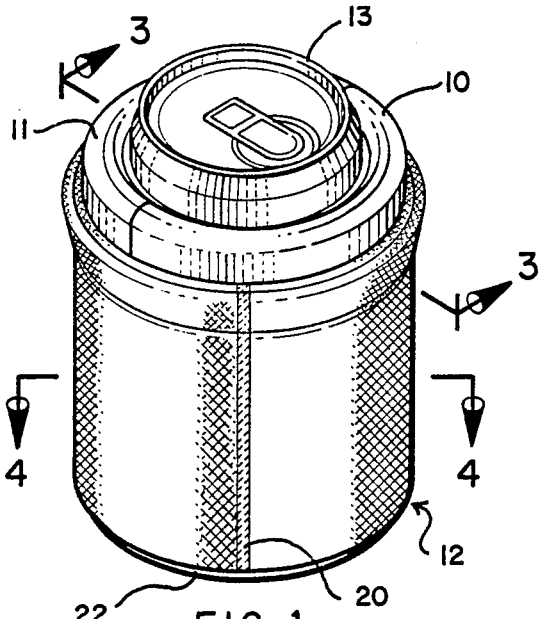
Figure 2:
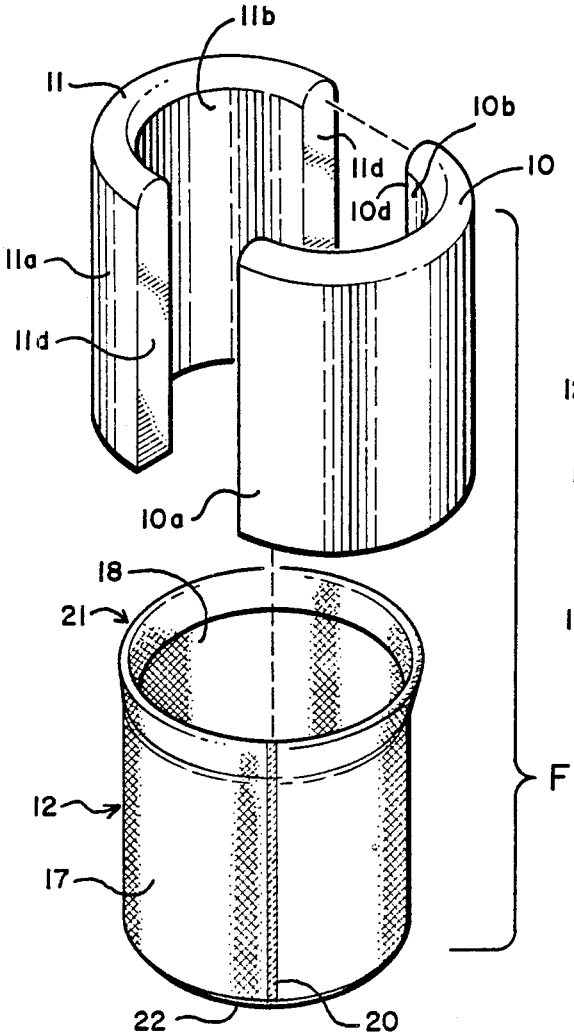

As shown in FIGS. 1 and 2, the device of the invention is made up of two arcuate reservoir pieces 10 and 11 which fit together against one-another in abutting side-by-side relationship to form a ring. The reservoir pieces 10 and 11 are held together in ring formation by a resilient sleeve 12 which is placed about the reservoir pieces when assembled into ring formation. With the sleeve about the reservoir pieces, the pieces are held together securely in their ring formation, but the pieces may be separated and spread apart upon pressure applied to them causing the sleeve to expand.

Figure 3:
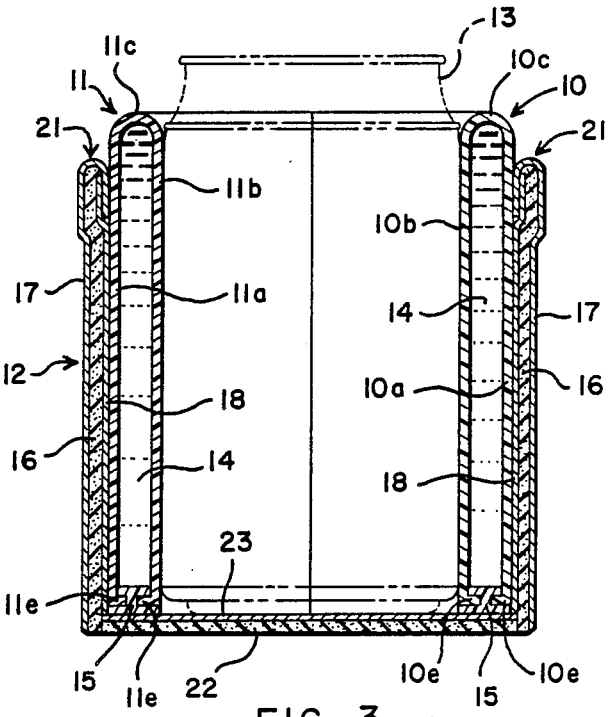

The height of the reservoir pieces will depend upon the height of the container to be cooled with the height of the pieces being somewhat less than the height of the container so that a user can still place his bottom lip on the edge of the container to drink therefrom. Thus, as shown in FIGS. 1 and 3, if a beverage can 13, such as a soda pop or beer can, is the container to be cooled, the height of the reservoir pieces are somewhat less than the height of the can. If the container is merely to be cooled and it is not anticipated that it will be drunk from, the height of the pieces may be equal to or greater than the height of the container. This, however, makes removal of the container from the device more difficult.

With the reservoir pieces assembled to form a ring, the container to be cooled is inserted into the open area of the ring formed by the reservoir pieces. It is preferred that the open area of the ring be equal to or just slightly smaller in diameter than the smallest diameter containers expected to be used with the device. In this way, when the smallest diameter container is inserted into the opening in the ring, a snug fit results with good contact between the container and the reservoir walls. If larger diameter containers are inserted into the opening in the ring, the reservoir pieces separate, at least slightly, so that the container is received by and securely held in the device, again with good contact between the container and the reservoir walls. The reservoir pieces may be flexible enough to expand somewhat in their arcs to conform to the larger diameter cans. Generally, however, the extent of this expansion is very small and most beverage cans, particularly aluminum cans, will substantially conform to the arcuate configuration of the reservoir pieces as long as the pieces can separate to provide a larger opening.

Figure 4:
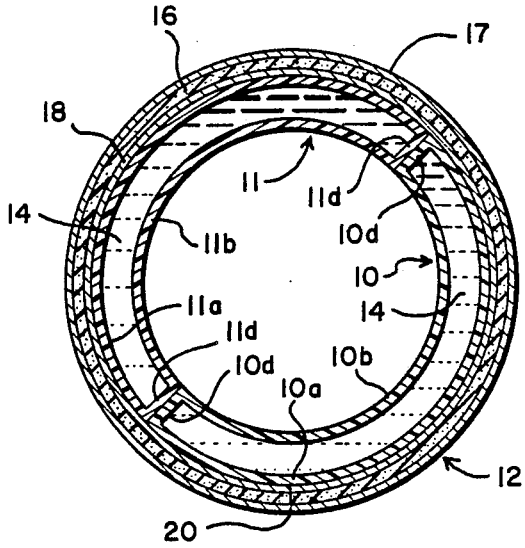

Each reservoir piece is hollow and filled with a coolant material 14. As shown, each reservoir piece may be conveniently made of a main section having side walls 10*a* and 10*b* and 11*a* and 11*b* joined by top wall 10*c* and end walls 10*d*, and top wall 11*c* and end walls 11*d*, respectively, FIGS. 3 and 4. The main reservoir sections are closed and sealed by bottom pieces 15, FIG. 3, having grooves therein which receive lips 10*e* and 11*e*, respectively, at the bottom of side walls 10*a* and 10*b* and 11*a* and 11*b*, respectively. The lips and grooves, as shown, are exaggerated to some extent for purposes of illustration. In addition to bottom pieces 15 being snapped in place in the main sections, they will also generally be glued or ultrasonically welded in place to form a fluid tight seal for permanently enclosing the coolant material inside the pieces. The reservoir pieces may be made of various materials, with a plastic material such as polyethylene having been found satisfactory. It has also been found satisfactory to injection mold the pieces in the configurations shown. The top walls 10*c* and 11*c* are preferably sloped or arcuate, as shown, to facilitate insertion of a can larger than the receiving opening in the ring.

In assembly of the reservoir pieces, it has been found convenient to hold the main sections with their open bottom upwardly and to fill them with the coolant material. The bottoms are then snapped into place on top of the inverted main sections. The reservoir pieces are then moved from the filing area to another area where the bottoms are ultrasonically welded to the main sections to thereby seal the coolant material in the reservoir pieces. Having the bottoms snapped into the main sections allows the reservoir pieces to be moved without substantial chance of spillage of the coolant. Depending upon the coolant, a small space may be left unfilled in the hollow area of the reservoir pieces to allow for expansion of the coolant material when frozen.

The presently preferred coolant material is a material that is either a liquid or a gel at room temperature and that can be easily be frozen into a solid in a household refrigerator freezer. While water could be used, it is preferred to use a material which absorbs more heat in melting than water and thus a greater cooling capacity than water. Material such as that commercially available for use in camping coolers as a replacement for ice is satisfactory. A coolant made up of about 85% water, 14% starch, and 1% borax has been found satisfactory. This material takes the form of a gel in the reservoir pieces.

Sleeve 12 is made of a resilient, preferably insulating material 16 such as a closed cell neoprene rubber which is fabric backed on both sides. Thus, there is a fabric backing 17 about the exterior of the sleeve and fabric backing 18 about the inner surface of the sleeve. A nylon backed, closed cell neoprene which has been found satisfactory is sold by Rubatex, Bedford, Va., under the trademark Rubatex. The sleeve may be conveniently made of a length of the material with ends glued together at seam 19 as is common for such material to form the sleeve. The seam 19 may additionally be stitched together for reinforcement as shown in FIG. 1 at 20. The outer fabric backing 17 provides a nice appearance for the sleeve and absorbs any moisture which may form thereon, while the inner fabric backing allows the sleeve to easily slip on or off of the respective reservoir pieces 10 and 11. The top edge of sleeve 12 is rolled over as shown at 21, FIG. 3, to provide a nice appearing top edge. A bottom 22, FIG. 3, is secured, such as by glueing, at the bottom edge of the sleeve 10 and is preferably a closed cell neoprene backed on a single side by fabric backing 23. The fabric backing is arranged on the inside of the sleeve bottom to facilitate sliding of the reservoir pieces and can thereon. The outer side, or bottom, of the bottom 22 is neoprene rubber which forms an anti-skid surface for the bottom of the device. This surface may be textured, if desired.

Although the drawings show the outer sleeve extending in height to near the top of the reservoir pieces, but not over them, this is done for ease of illustration to show the assembly of the device in FIG. 1, and usually the sleeve will be sized to fit just over the top of the reservoir pieces. Also, while two reservoir pieces are shown, and this is presently preferred for ease of assembly, more reservoir pieces could be used.

In use, the reservoir pieces are placed in a freezer to freeze the coolent material therein. They are held in the freezer until used. When used, the reservoir pieces are removed from the freezer and assembled into a ring by placing them into the resilient sleeve 12 in abutting, side-by-side relationship. The beverage or other can to be cooled is placed in the ring formed by the reservoir pieces as shown in FIG. 1. Cooling of the beverage or other contents of the can is provided by the melting of the coolant and by the rise in temperature of the coolant.

It has been found that with reservoir pieces containing a total of 3.8 oz. of coolant, with the coolant frozen and the drink initially at 55° F. when inserted into the device, at 95° F. ambient temperature and in direct sunlight, the temperature of the drink drops to 38° F. and remains between 38° and 45° F. for about two hours. Under the same conditions, but in the shade with ambient temperature at 85° F., the drink will remain between 38° and 45° for about three hours.

While removing the reservoir pieces from the insulating sleeve for freezing allows faster freezing of the coolant and takes up less room in the freezer, the assembled device with sleeve in place may be placed in the freezer to freeze the coolant and operation of the device is the same.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A cooling and insulating device for containers such as beverage cans and the like, comprising a plurality of hollow, arcuate reservoir pieces, the number of pieces being such that when placed together in abutting, side-by-side relationship they form a ring with an opening therethrough forming open ends of the ring; coolant material within each of said reservoir pieces; and resilient means surrounding at least a portion of said reservoir pieces when placed together to form a ring for biasing said reservoir pieces inwardly thereby maintaining said reservoir pieces in ring formation and allowing said reservoir pieces to separate against the bias of the resilient means and snugly receive a container larger than the opening, said resilient means providing a surface for holding said device in the hand of a user and also extending across an open end of the ring to form a bottom therefor.

2. A cooling and insulating device according to claim 1, wherein the resilient means is a resilient sleeve surrounding the reservoir pieces.

3. A cooling and insulating device according to claim 2, wherein the resilient sleeve is removable from about the reservoir pieces.

4. A cooling and insulating device according to claim 3, wherein there are two reservoir pieces.

5. A cooling and insulating device according to claim 4, wherein the opening in the ring is sized to snugly receive a beverage can having the minimum outside diameter of commonly available beverage cans, thereby requiring the reservoir pieces to separate from each other upon receipt of a can of larger than the minimum outside diameter.

6. A cooling and insulating device according to claim 5, wherein the top edges of the reservoir pieces are rounded to facilitate entry of a can having a diameter larger than the opening in the ring.

7. A cooling and insulating device according to claim 6, wherein the height of the reservoir pieces are less than the height of the container to be cooled by an amount sufficient to allow a user to drink from the container being cooled.

8. A cooling and insulating device according to claim 7, wherein the resilient sleeve surrounds the outside surfaces of the reservoir pieces.

9. A cooling and insulating device according to claim 8, wherein the coolant in the reservoir pieces is frozen prior to use of the device.

10. A cooling and insulating device according to claim 9, wherein the coolant material is an aqueous solution including about 14% starch and 1% borax.

11. A cooling and insulating device according to claim 2, wherein the resilient sleeve has an interior surface of low coefficient of friction to facilitate easy insertion of the reservoir pieces into the sleeve.

12. A cooling and insulating device according to claim 11, wherein the resilient sleeve is made of a fabric backed neoprene rubber.

13. A cooling and insulating device according to claim 1, wherein there are two reservoir pieces.

14. A cooling and insulating device according to claim 1, wherein the opening in the ring is sized to snugly receive a container having the minimum outside diameter of containers expected to be used with said device, thereby requiring the reservoir pieces to separate from each other upon receipt of a container larger than the minimum outside diameter.

15. A cooling and insulating device according to claim 14, wherein the top edges of the reservoir pieces are rounded to facilitate entry of a container having a diameter larger than the opening in the ring.

* * * * *